United States Patent [19]

Pitman et al.

[11] Patent Number: 5,012,939

[45] Date of Patent: May 7, 1991

[54] COLOR CODED BOOM AND CHART SYSTEM FOR PROPORTIONALLY EXTENSIBLE BOOM ASSEMBLY

[75] Inventors: Raymond F. Pitman, Prairie Village; Raymond J. Wacht, Overland Park, both of Kans.

[73] Assignee: Simon-RO Corporation, Olathe, Kans.

[21] Appl. No.: 399,843

[22] Filed: Aug. 29, 1989

[51] Int. Cl.[5] ..... B66C 13/16

[52] U.S. Cl. ..... 212/157; 212/231; 212/264

[58] Field of Search ..... 212/156, 230–231, 212/244, 255, 264, 265, 267, 268; 52/118–121; 116/272, 281, 283, DIG. 21; 414/718, 728; 182/2, 18

[56] References Cited

U.S. PATENT DOCUMENTS

| | | | |
|---|---|---|---|
| 3,609,974 | 10/1971 | Lado | 212/162 |
| 3,657,969 | 4/1972 | Wirkus | 212/268 |
| 4,211,332 | 7/1980 | Pitman | 212/157 |
| 4,359,137 | 11/1982 | Merz et al. | 212/157 |
| 4,770,044 | 9/1988 | Ferris | 116/272 |

FOREIGN PATENT DOCUMENTS

| | | | |
|---|---|---|---|
| 3606590 | 9/1987 | Fed. Rep. of Germany | 212/267 |
| 432087 | 12/1974 | U.S.S.R. | 212/157 |
| 887444 | 12/1981 | U.S.S.R. | 212/157 |

OTHER PUBLICATIONS

Drott Manufacturing Brochure—CC180M6, 6/75; Drott Cruz-Crane, Model 1800.

Manitour BF Brochure—Bit Maniscopic, MT 450.

*Primary Examiner*—Joseph F. Peters, Jr.

*Assistant Examiner*—R. B. Johnson

*Attorney, Agent, or Firm*—Hovey, Williams, Timmons & Collins

[57] ABSTRACT

In a multiple stage boom including a base boom and a plurality of relatively extensible and retractable boom stages, a system for displaying the load rating information relative to the boom includes an angle measuring assembly and a color coded boom and chart assembly. A plurality of separate markings are provided on and spaced from one another along the length of an intermediate boom stage of the boom in such a way as to be sequentially revealed when the boom stages are extended from a retracted position. Each of the markings are representative of the length of the boom at the point of extension of the boom where the marking is first revealed on the boom. A plurality of color sections extend along the intermediate boom stage, each of which is provided between a different pair of the markings and is colored differently than the other color sections to provide visible confirmation of the distance of extension of the boom. A boom load rating chart is also provided which is adapted to be observable by a boom operator during boom operation and which presents a plurality of separate color regions each corresponding to one of the color sections on the intermediate boom stage for facilitating location of the region of the chart corresponding to the indicated distance of extension of the boom.

1 Claim, 2 Drawing Sheets

COLOR CODED BOOM AND CHART SYSTEM FOR PROPORTIONALLY EXTENSIBLE BOOM ASSEMBLY

BACKGROUND OF THE INVENTION

1. Field of the Invention

The present invention relates generally to a multiple extension telescoping boom apparatus and, more particularly, to a color coded boom and boom load rating chart for simplifying the calculation of the load rating for any given boom extension distance of the boom apparatus.

2. Discussion of the Prior Art

A color coded boom and chart system is disclosed in U.S. Pat. No. 4,211,332, to Pitman. In this known device, a truck mounted crane is provided with a boom having multiple stages which are sequentially extendable such that when it is desired to extend the boom, intermediate and outer boom stages are moved together relative to the inner boom stage until the intermediate stage is fully extended, at which time the outer stage continues to extend until it reaches its fully extended position. Each of the stages is colored relative to the other stages, and a correspondingly colored chart is included on the truck for simplifying the procedure used to determine the magnitude of a load that may be safely carried by the boom at any given angle and extension distance thereof.

Although the color coded boom and chart system disclosed in U.S. Pat. No. 4,211,332 simplifies the interpretation of load rating charts as compared with prior known systems, it would be desirable to further improve the color coded system to permit the use of the system with boom constructions including proportionally extended boom stages which move simultaneously during extension and retraction of the boom. In addition, it would be advantageous to further reduce the number of steps necessary in determining the load rating of a boom at any given angle and boom extension distance while increasing the accuracy of the system to include substantially more load rating data than in known systems.

OBJECTS AND SUMMARY OF THE INVENTION

It is an object of the present invention to provide a color coded boom and boom load rating chart which answers the needs discussed above with reference to the known systems, and which further simplifies the manner in which a crane operator determines the maximum load that can be safely carried by a boom at any given angle and boom extension distance.

Another object of the invention is to provide a color coded boom and boom load rating chart which may be employed in connection with a boom having proportionally extendable boom stages in order to reduce the chance of error in reading and interpreting the boom load rating chart.

In accordance with one aspect of the invention, in a multiple stage boom including a base boom and a plurality of relatively extensible and retractable booms stages, a system for displaying the load rating information relative to the boom includes an angle measuring assembly and a color coded boom and chart assembly. A plurality of separate markings are provided on and spaced from one another along the length of one boom stage of the boom in such a way as to be sequentially revealed when the boom stages are extended from a retracted position. Each of the markings are representative of the length of the boom at the point of extension of the boom where the marking is first revealed on the boom. A plurality of color sections extend along the one boom stage, each of which is provided between a different pair of the markings and is colored differently than the other color sections to provide visible confirmation of the distance of extension of the boom as the color sections are revealed along with the markings on the one boom stage during extension of the boom stages. A boom load rating chart is also provided which is adapted to be observable by a boom operator during boom operation and which presents a plurality of separate color regions each corresponding to one of the color sections on the one boom stage for facilitating location of the region of the chart corresponding to the indicated distance of extension of the boom.

BRIEF DESCRIPTION OF THE DRAWING FIGURES

A preferred embodiment of the invention is described in detail below with reference to the attached drawing figures, wherein.

DETAILED DESCRIPTION OF THE PREFERRED EMBODIMENT

Figures 1, 2, 3:
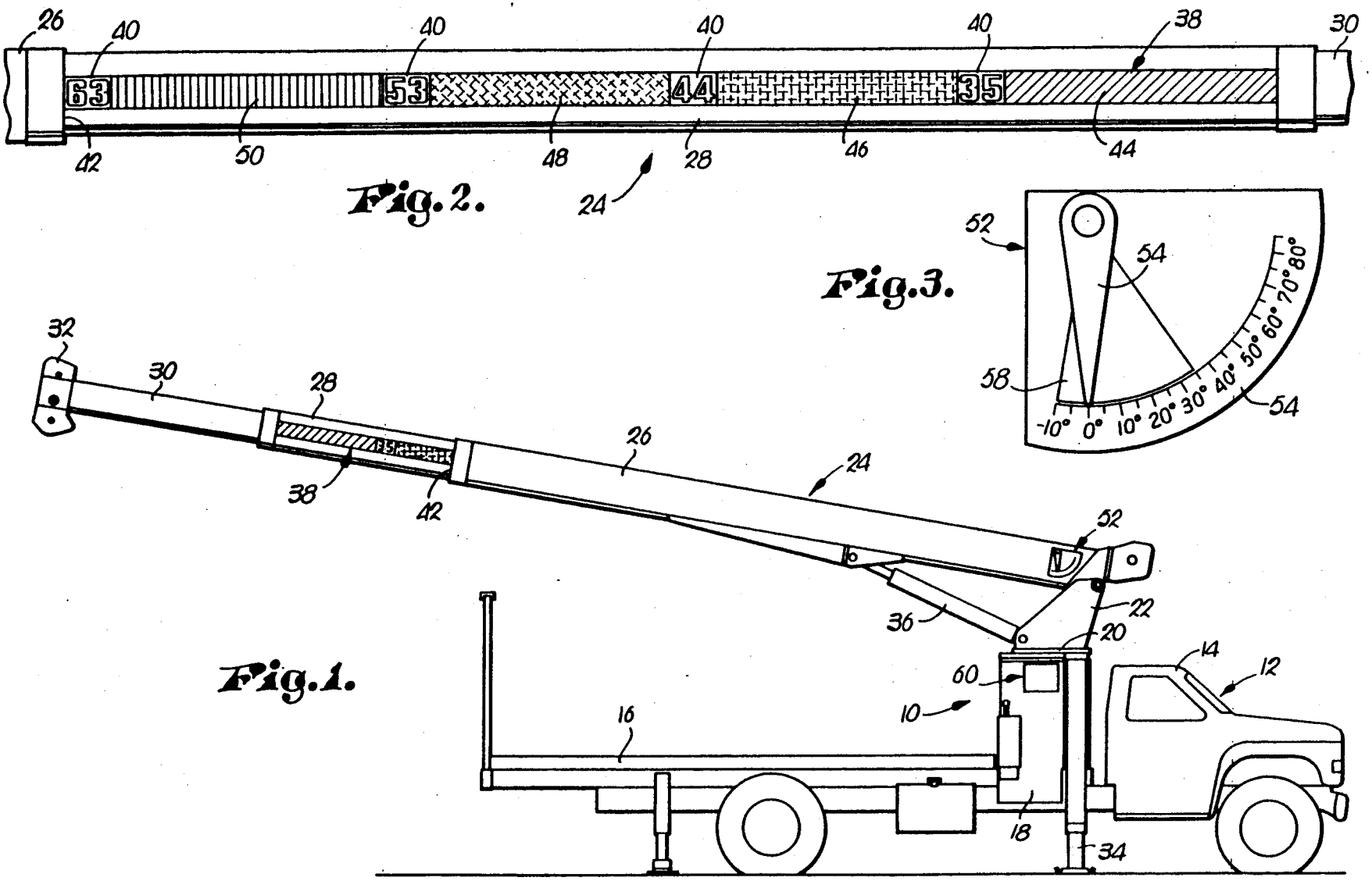
FIG. 1 is a side elevational view of a truck having a color coded boom load rating chart and a multiple extension telescoping boom which is colored in accordance with the preferred embodiment of the invention.
FIG. 2 is a fragmentary side elevational view of a boom extension having a number of markings and color coded segments thereon.
FIG. 3 is an elevational view of a boom angle chart.

A truck mounted crane is illustrated in FIG. 1, which includes a preferred embodiment of the boom and boom load rating chart of the present invention. As shown in FIG. 1, the crane 10 is disposed on a truck 12 at a position directly rearward of a cab 14 of the truck and forward of a bed 16 onto which construction materials and the like may be loaded and unloaded.

The crane includes a frame 18 mounted to the truck, and a turntable 20 mounted on top of the frame for rotation relative thereto about a vertical axis. Further, a boom turret 22 supporting a multiple stage boom 24 is pivotally mounted on the turntable to pivot about a horizontal axis such that the boom may be lifted by a hydraulic cylinder assembly, 36, between a lowered position disposed somewhat below horizontal, and a raised position which is substantially vertical.

The boom 24 is preferably constructed of three or more sections or stages, including a base stage 26 mounted on the boom turret 22, an intermediate stage 28 slidably received in the base stage, and an outer stage 30 slidably received in the intermediate stage. Each of the stages 28, 30 are colored a different color than the base boom stage 26 in order to facilitate observation of the base boom stage. A set of sheaves 32 are carried at the free end of the outer stage for guiding a cable extending along the boom between a winch on the base stage of the boom and a hook or other lifting tackle hanging downward from the sheaves. Outriggers 34 are also included on the truck, and function to stabilize the truck when the boom 24 is used to handle loads which are to be supported over the sides of the truck. A removable jib may also be provided for use as an extension from the outer boom stage 30 for lengthening the overall length of the boom when desired.

A hydraulic cylinder assembly is not shown provided within the boom 24 to move the stages between the fully retracted and fully extended positions in such a manner that the intermediate stage 28 moves, outward from the base stage 26 at the same rate as the outer stage 30 moves relative to the intermediate stage 28. Thus, axial movement of the intermediate stage is proportional to axial movement of the outer stage.

The intermediate boom stage 28 is illustrated in FIG. 2, and includes extension indicating means 38 for indicating the total distance of extension of the boom 24 at different positions thereof. This extension indicating means includes a plurality of separate markings 40 provided along at least one side of the intermediate boom stage 28 which are representative of the distance of total extension of the boom. The markings 40 are spaced from one another along the length of the intermediate stage 28, and as the boom is extended or retracted, the markings are correspondingly either exposed or covered up by the base stage 26.

Thus, the outer end 42 of the base stage serves as a pointer and each marking 40 on the intermediate stage 28 represents the length of the boom at the point of extension where the marking is first exposed by the base boom. By providing numerals as the markings 40, it is further possible to accurately estimate the total length of the boom by viewing the marking 40 closest to the end of the base boom stage and approximating any additional distance between the end of the base boom and that closest exposed numeral.

A plurality of color sections 44, 46, 48, 50 are provided along the intermediate boom stage between the plurality of markings. Each of these color sections extend between two of the markings 40 and are colored differently than the other color sections in order to provide visible confirmation of the distance of extension of the boom. The color sections 44, 46, 48, 50 are also colored differently than the base boom stage 26 and the stages 28, 30 in order to facilitate observation of the color sections on the intermediate boom stage 28. For example, a color scheme may be provided on the intermediate stage wherein the section 44 located furthest from the base stage in the fully extended position of the boom is beige, with the other sections 46, 48, 50 which are successively closer to the base stage being yellow, orange and red respectively. In this manner, the intensity of the color also provides some indication of the load rating of the boom at any specific position thereof since the colors of the sections exposed by the base boom become closer to red as the length of the boom is increased. In addition, the base stage 26 may be colored white in order to further assist in the interpretation of the load rating chart discussed below.

As shown in FIG. 1, an angle measuring means 52 is provided for measuring and indicating the angle at which the boom 24 is disposed during pivotal movement thereof. This angle measuring means 52 is illustrated in detail in FIG. 3, and includes a pendulum type pointer 54 which is pivotally supported on a side of the base boom stage 26 in such a way as to hang freely from the boom. An angle indicating scale 56 is fastened to the base stage between the pointer and the boom, with the scale oriented to accurately indicate the angle of the boom throughout the entire range of possible boom movement. Further, a section 58 of the scale may be colored to indicate a predetermined range of angles at which the load rating of the boom is significantly decreased in order to warn an operator of the potential for danger in lifting a load of a given size through the range of angles. By providing this angle measuring means 52, an operator need only refer to the scale 56 in order to determine the angle at which the boom is disposed.

Returning to FIG. 1, a boom load rating chart 60 is illustrated as being attached to the frame 18 at a position which is easily viewed by an operator working the boom. This chart 60 is shown in detail in FIG. 4, and includes a range diagram 62 and a load rating table 64.

In the range diagram 62, information relating to the operating radius and sheave height of the boom 24 is illustrated in relation to the different angles of the boom. The diagram 62 includes a plurality of spaced apart radius lines 66 drawn from a common point corresponding to the horizontal pivot axis of the boom. The outermost radius lines are indicated at **66*a*. Spaced arc lines 68, 70, 72, 74, 76 are struck about the same central point and intersect the radius lines 66**. Each radius line is labeled beyond its end to indicate that it corresponds with a particular angle of the boom relative to a horizontal plane.

Also provided on the diagram 62 are a plurality of uniformly spaced vertical lines 78 which are located and labeled to indicate the effective horizontal length of the boom at various positions thereof. A number of horizontal lines 80 are uniformly spaced apart from one another and are located and labeled such that the height of the sheaves above the ground is indicated at various boom positions.

The pie-shaped section 82 of the diagram presented between the central axis and the arc line 68, and between the two outermost radius lines **66*a*, corresponds to the the length of the boom with all of the boom stages retracted, and is colored the same color as the base boom stage 26, e.g. white. The arcuate section 84 located between arc lines 68 and 70, and the outer radius lines 66*a* corresponds to the length of the boom when the intermediate and outer boom stages are extended to a position wherein only the first color section 44 of the intermediate boom stage is exposed by the base stage to be visible to an operator. This arcuate section 84 of the diagram is colored the same color as the color section 44 on the intermediate boom, e.g. beige. Another arcuate section 86 is defined between arc lines 70 and 72, and the outer radius lines 66*a*, and corresponds to the length of the boom when the intermediate and outer stages are extended to a position wherein only the first and second color sections 44, 46 of the intermediate boom stage are visible to an operator. This arcuate section 86 is colored the same color as the second color section 46** on the intermediate boom stage, e.g. yellow.

Two additional arcuate sections 88, 90 are also provided. One of the sections 88, defined between the arc lines 72 and 74, and the radius lines **66*a*, corresponds to the length of the boom when the intermediate and outer stages are extended to a position wherein the first, second and third colored sections 44, 46, 48 of the intermediate boom stage are exposed. The color of both the arcuate section 88 of the diagram 62 and the color section 48 on the intermediate boom are the same, e.g. orange. The other of these additional sections 90 is bordered by the arc lines 74 and 76, and the radius lines 66*a*, and corresponds to the length of the boom when all of the colored sections of the boom are visible and the boom is substantially fully extended. This arcuate section 90 of the diagram is colored the same color as the color section 50 adjacent the base stage 26** in the fully extended position of the boom, e.g. red.

Figure 4:
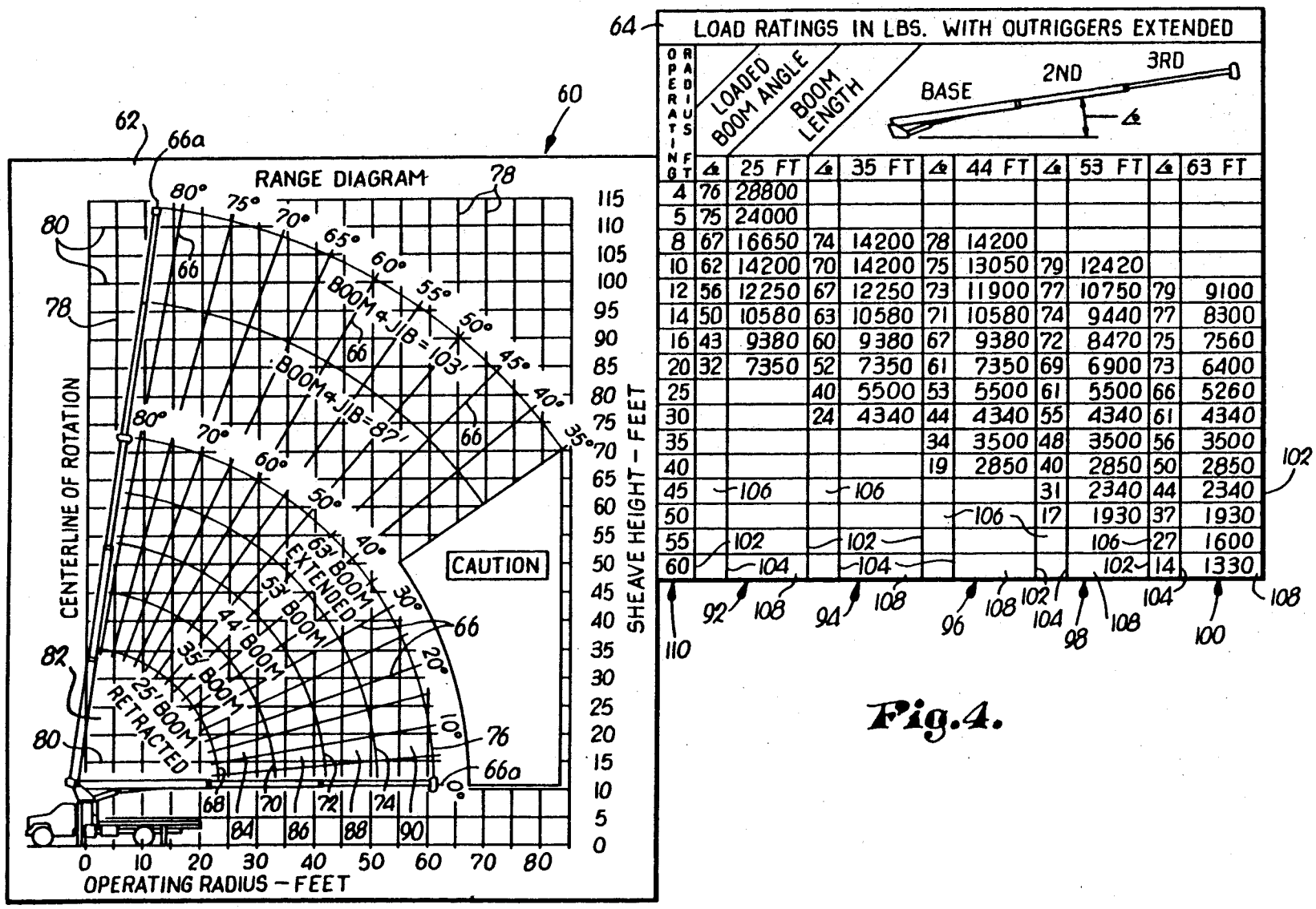
FIG. 4 is an elevational view of a boom extension distance and load rating chart.

The load rating table is also shown in FIG. 4 and includes five vertical sections 92, 94, 96, 98, 100 defined by six vertical lines 102. Each section includes information relating to the boom load rating for one of the color sections on the intermediate stage, and is provided with a vertical line 104 which divides the section into a pair of columns 106, 108. The left hand column 106 of each vertical section is used for presenting indicia representative of the loaded boom angle, while the right hand column 108 presents indicia representative of the load rating of the boom for a given boom length.

The first vertical section 92 corresponds to the length of the boom with all of the boom stages retracted, and is colored the same color as the base boom stage 26, e.g. white. The second vertical section 94 corresponds to the length of the boom when the intermediate and outer boom stages are extended to a position wherein only the first color section 44 of the intermediate boom stage 28 is exposed by the base stage so as to be visible to an operator. This vertical section 94 of the table 64 is colored the same color as the color section 44 on the intermediate boom, e.g. beige.

The third vertical section 96 corresponds to the length of the boom when the intermediate and outer stages 26, 30 are extended to a position wherein only the first and second color sections 44, 46 of the intermediate boom stage 28 are visible to an operator. This vertical section 96 is colored the same color as the second color section 46 on the intermediate boom stage, e.g. yellow.

The fourth vertical section 98 corresponds to the length of the boom when the intermediate and outer stages are extended to a position wherein the first, second and third colored sections 44, 46, 48 of the intermediate boom stage are exposed. The color of both the vertical section 98 of the table 64 and the color section 48 on the intermediate boom are the same, e.g. orange. The right-hand vertical section 100 corresponds to the length of the boom when all of the colored sections of the boom are visible and the boom is substantially fully extended. This vertical section 100 of the table 64 is colored the same color as the color section 50 adjacent the base stage in the fully extended position of the boom, e.g. red. A further vertical column 110 is also provided which includes indicia relating to the operating radius of the boom as determined from the range diagram 62.

By constructing the load rating table 64 in this manner, load rating information is presented along with information relating to the operating radius of the boom, the loaded boom angle, the boom length as indicated by the markings on the intermediate stage, and the color sections provided on the intermediate stage. Thus, it is possible to find the proper load rating for a given situation without having to refer to the range diagram, if desired, simply by determing the loaded angle of the boom from the angle measuring means and the length of the boom from either the markings or the color sections on the intermediate stage. In addition, if an operator wishes to know the distance from the truck which a predetermined load may be lifted, he may refer to the table and determine the maximum operating radius which can be achieved for a given boom length and load.

When the crane 10 is to be used in an area where the vertical space above the boom is restricted, the range diagram 62 may be useful in determining the sheave height for any given boom length and angle. In addition, the diagram 62 presents a visual representation of the boom 24 and tends to simplify the reading of the load rating table by illustrating the arrangement of the color sections and markings on the intermediate boom stage 28.

Although the invention has been described with reference to a preferred embodiment, it is noted that substitutions may be made and equivalents employed herein without departing from the scope of the invention as set forth in the claims.

What is claimed is:

1. In combination with a multiple stage boom including a base boom and a plurality of relatively extensible and retractable boom stages, and means mounting the base boom for pivoting movement thereof about a horizontal axis, the improvement comprising:

angle measuring means operatively coupled with the boom for measuring and indicating the upright angle at which the boom is disposed during pivotable movement thereof about a horizontal axis;

extension indicating means for indicating the distance of extension of the boom from the horizontal pivot axis thereof to the outermost end of the boom, the extension indicating means including— a plurality of separate markings provided on and spaced from one another along the length of one of the extensible and retractable stages, said one stage being the stage located adjacent the base boom, the markings being sequentially revealed when the boom stages are extended from a retracted position, each of the markings being representative of the total length of the boom at the point of extension of the boom stages where that marking is first revealed on the boom, a plurality of color sections extending along the one boom stage, each of the color sections being provided between a different pair of the markings and being colored differently than the other color sections to provide visual confirmation of the distance of extension of the boom as the color sections are revealed along with the markings on the one boom stage during extension and retraction of the boom stages, said base boom and boom stages each being colored differently from said color sections; and a boom load rating chart adapted to be observable by a boom operator during boom operation and presenting thereon a table and a diagram, the table including a plurality of columns each colored in a color corresponding to, respectively, said base boom color and one of the color sections of the extension indicating means for facilitating location of the column of the table corresponding to the indicated distance of extension of the boom, and being provided with numerals in each of the columns corresponding to the different angles at which the boom may be disposed as indicated by the angle measuring means so that it is possible to located the applicable information in the table by noting the exposed color sections on the one boom stage, and the color of said base boom, and the angle indicated by the angle measuring means and locating the corresponding column and numerals on the table, the diagram including a plurality of arcuate sections each colored in a color corresponding to, respectively, said base boom color and one of the color sections of the extension indicating means for facilitating location of the arcuate section of the diagram corresponding to the boom, the diagram further including numbers representative of the operating radius of the boom for various angles and lengths of extension of the boom so that it is possible to determine the operating radius of the boom by noting the exposed color sections on the one boom stage, and the color of the base boom, and the angle indicated by the angle measuring means and locating the corresponding numbers on the diagram.

* * * * *